United States Patent [19]

Shay

[11] 4,437,588

[45] Mar. 20, 1984

[54] ACCUMULATIVE PRESSURE PUMP

[75] Inventor: Joseph J. Shay, Waterbury, Conn.

[73] Assignee: Ethyl Products Company, Richmond, Va.

[21] Appl. No.: 335,368

[22] Filed: Dec. 29, 1981

[51] Int. Cl.[3] ..... B65D 47/34

[52] U.S. Cl. ..... 222/321; 222/382; 222/385

[58] Field of Search ..... 222/321, 382, 385; 239/333

[56] References Cited

U.S. PATENT DOCUMENTS

| | | | |
|---|---|---|---|
| Re. 28,366 | 3/1975 | Pechstein | 239/333 |
| 1,941,898 | 1/1934 | Iddings . | |
| 2,995,278 | 8/1961 | Clapp | 222/394 |
| 3,191,817 | 6/1965 | Furutani | 222/394 |
| 3,774,849 | 11/1923 | Boris | 239/338 |
| 3,840,157 | 10/1974 | Hellenkamp | 222/309 |
| 3,908,870 | 9/1975 | Nozawa et al. | 222/321 |
| 3,923,250 | 12/1975 | Boris | 239/321 |
| 4,017,031 | 4/1977 | Kishi et al. | 239/333 |
| 4,051,983 | 10/1977 | Anderson | 222/321 |
| 4,278,189 | 7/1981 | Kirk, Jr. | 222/321 |
| 4,317,531 | 3/1982 | Saito et al. | 222/321 |
| 4,361,255 | 11/1982 | Saito et al. | 222/321 |

*Primary Examiner*—Joseph J. Rolla
*Assistant Examiner*—Kevin P. Shaver
*Attorney, Agent, or Firm*—Donald L. Johnson; John F. Sieberth; E. Donald Mays

[57] ABSTRACT

An accumulative pressure pump that has upper and lower pressure chambers of different diameters, each of which is provided with a piston having a connected stem. A third seal piston is provided between the upper and the lower piston. Inlet and outlet check valves are provided. The outlet valve opens on accumulation of pressure on the downward stroke of the two pistons. The lower portion of the inner sidewall of the lower chamber is provided with a rib or a recess to permit any air trapped in the two chambers to be expelled through a bottom opening that is provided in the lower chamber. The dip tube is connected directly to the second piston and has its end abutting or adjacent the bottom of the container and is reciprocal with the second piston whereby its lower end moves into the lowermost portion of the container to permit substantial removal of the entire contents of the container.

15 Claims, 6 Drawing Figures

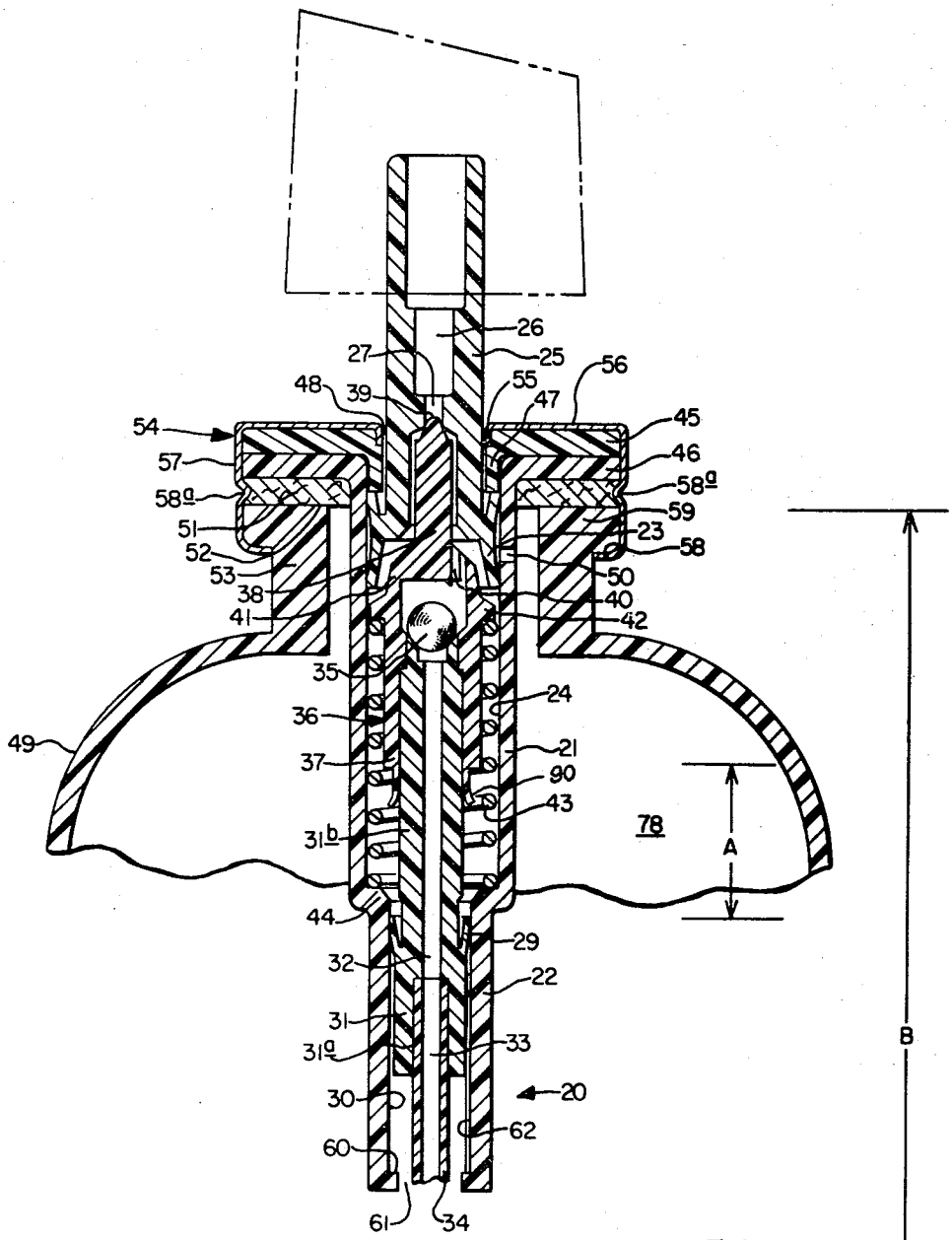
FIG. 1.
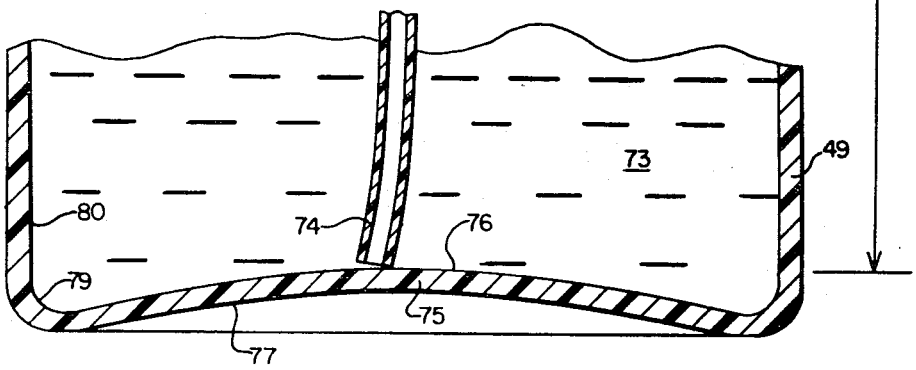

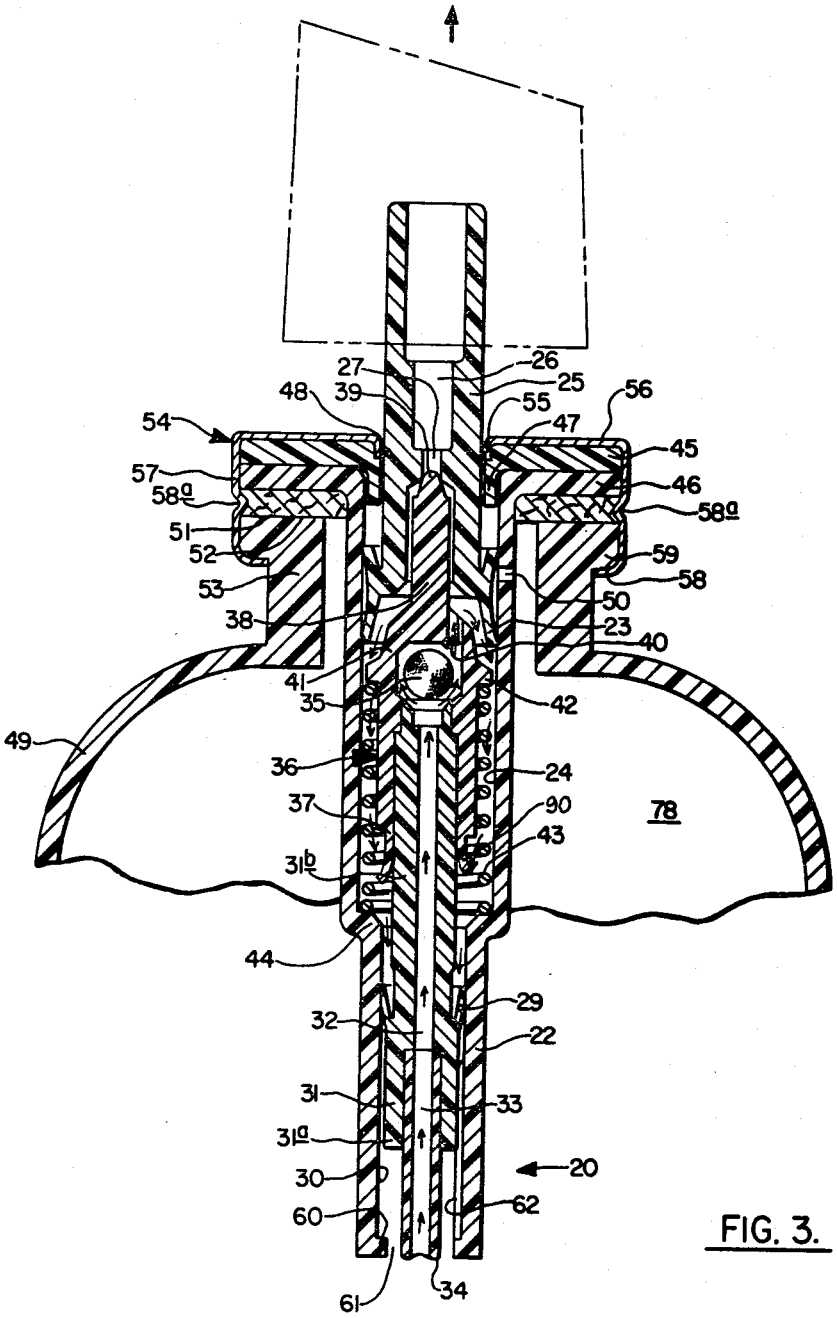
FIG. 3.
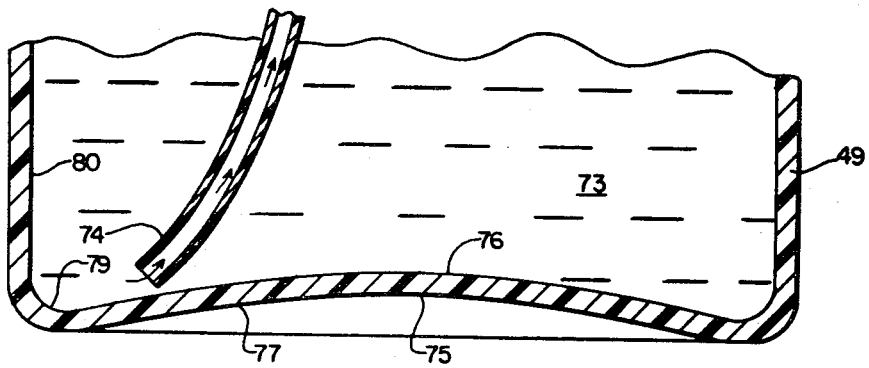

ACCUMULATIVE PRESSURE PUMP

BACKGROUND OF THE INVENTION

1. Field of the Invention

The present invention relates to a dispenser pump, particularly a miniature, finger-actuated, dispenser pump for atomizing perfumes, colognes or other personal care products from small containers.

2. Description of the Prior Art

This invention is an improvement to the accumulative pressure pump disclosed in U.S. Pat. No. 4,278,189.

In recent years, there has been an increase in demand for small-size, finger-actuated pump dispensers, particularly for use in atomizing colognes, perfumes and other personal care products from small, hand-held containers. Generally, these containers are preferably glass to assure the purity of the perfume, cologne or other products. An additional advantage of glass containers for colognes or perfumes is to permit the visual determination of the level of the product remaining in the container. Also, glass containers permit art decorations to be applied thereto to make aesthetically pleasing packages. Prior to the recent demand for small, miniature finger pumps, these types of cologne and perfume dispensers were generally glass bottles having a plastic coating which were pressurized with chloro-fluoro hydrocarbon propellants and utilized conventional aerosol valves for dispensing the product. However, present Federal regulations prohibit the use of chloro-fluoro hydrocarbon propellants in dispensing packages. Most aerosol packaging producers are presently utilizing aliphatic hydrocarbon propellants. However, these propellants have not been acceptable to the perfume and cologne packagers because of their odor.

Early attempts to adapt conventional, single-piston, large-size, finger-actuated pump dispensers to the small cologne or perfume containers did not prove too successful. When the conventional, large-size pumps were miniaturized, they did not provide good atomization of the perfume or cologne composition—normally prepared utilizing an alcohol or a water-alcohol base formulation. These pumps dribbled, i.e., did not atomize the perfume or cologne in sufficiently desirable small particle sizes to be effective, particularly at the beginning and end of the pump stroke.

The problem of instant atomization and the production of the desired particle size in the spray has been achieved by the double cylinder-double piston pumps, sometimes known as accumulative pressure pumps, which are currently available. Such pumps have a dual-diameter pump chamber or body, generally the upper portion being a larger diameter than the lower portion. Separate pistons are provided in each of the different diameter portions, which pistons move together on downstroke and produce accumulation of pressure in the two chambers resulting in disengagement of the outlet valve whereby fluid is expressed through the atomizer nozzle at an instantaneously high pressure to produce fine atomization from the start of the spray until the end thereof. Accumulative pressure pumps having interconnected, different diameter pump chambers or bodies are shown in U.S. Pat. Nos. Re. 28,366; 3,908,870; 3,923,250; 4,017,031; and 4,051,983.

The problem common to the miniaturized, double-piston, double-cylinder-type pumps is the difficulty in expressing the air from the dual cylinders or tank when priming the pump. Generally, these types of miniaturized pumps have very small dimensions and thus relatively small movement of their pistons to express air from the dual chamber or tank upon initial or secondary priming of the pump. One method for achieving the egress of air on priming a finger pump is shown in U.S. Pat. No. 3,774,849 which discloses the provision of either ribs or recesses on the inner wall of the pump chamber whereby the piston skirt is flexed to permit expression of air on the downstroke by the edge of the piston and allowing its exit through the atmospheric vent hole normally provided in the upper end of the pump chamber. This type of priming assistance is utilized in the sprayer shown in U.S. Pat. No. 4,051,983. However, the air is not vented through the normal side hole provided for entrance of atmospheric pressure to the container, but, rather, through the dip tube which is attached to the lower end of the lower, smaller diameter pump chamber. Thus, this results in having to force any liquid out of the dip tube in order to expell the air in the cylinder to achieve priming of the pump. Such an arrangement would appear to require an increased number of priming strokes in order to achieve full prime for the pump.

As indicated before, a problem in adapting miniaturized finger pumps for utilization in dispensers for perfumes and colognes is the difficulty in removing the last amount of liquid in the bottom of the dispenser since normally the dip tube does not extend into the lowermost point of the container and also is generally in a fixed position once the pump is installed on the container. Pressurized containers having dip tubes which are located adjacent the lowermost part of the container are shown in U.S. Pat. Nos. 1,941,898 and 2,995,278. However, these containers have the location of their dip tubes fixed due to the nature of their outlet valves.

One solution for obtaining the final amount of product in an aerosol container is shown in U.S. Pat. No. 3,191,817 wherein the dip tube is reciprocal to make contact with the flat bottom of the container.

Since most perfumes are packaged in glass containers, it is extremely difficult to precisely determine the length of a dip tube for a pump so that the dip tube will reach to the lowermost part of the container, generally that peripheral portion of the container wherein the sidewall joins the bottom since most glass containers have a crowned or convex upper surface to their bottom. Small glass containers are manufactured with quite wide tolerances for the distance between the uppermost point of the upper surface of the bottom of the container and the lip on the neck of the container. This dimension is critical in cutting and sizing the dip tube for miniaturized pumps so that the tube can extend as close to the bottom of the container as possible and yet not so contact the bottom that it restricts the entry into the tube when the end is square cut.

U.S. Pat. No. 3,840,157 discloses a hand-operated, trigger spray pump adapted for dispensing products such as household detergents or sprays or cleaners which are generally packaged in an opaque plastic bottle. This pump utilizes a reciprocating vertical plunger which has the dip tube attached to the bottom end thereof so that it moves up and down as the pump is actuated. However, the dip tubes in these types of pumps are generally cut sufficiently short so that, even upon full extension, the dip tube does not contact the bottom of the container since the tubes are relatively stiff and are thus prone to blockage if allowed to contact the bottom surface of the container. Additionally, the products are generally of a far less expensive nature than colognes or perfumes, and the consumer does not have the incentive to utilize the last few ounces of product remaining in the container.

Thus, it can be seen that there is a need in the miniature atomizing pump art to provide a pump atomizer particularly suited for perfumes, colognes and personal products which are generally expensive which will permit the dip tube to extend into the lowermost portion of the container, generally that peripheral portion of the container defined by the intersection of the sidewalls and the bottom of the container. Such a pump will permit the extraction of the maximum amount of the contents of the container.

While the pump disclosed in U.S. Pat. No. 4,278,189 overcame many of the disadvantages of the foregoing prior art pumps, further improvement in this pump was desirable. This pump, and other pumps of the type disclosed in U.S. Pat. No. 4,051,983 vent the liquid remaining between the upper and the lower pistons into the container when the lower piston skirt is deflected at the bottom of stroke. Thus, there is a need for an accumulative pressure pump that will retain the major portion of the fluid between the upper and lower pistons when the pump is at the bottom of the stroke.

SUMMARY OF THE INVENTION

It is an object of the present invention to provide an atomizer for liquids which will permit rapid priming of liquid to the pump on initial and subsequent uses;

It is another object of the present invention to provide an atomizing pump which permits the utilization of substantially all of the contents of the container on which it is mounted;

It is also an object of the present invention to provide an atomizer pump which can be readily assembled by utilization of the minimum number of components;

It is an additional object of the present invention to provide an atomizer pump wherein the major components of the pump are contained within the container to which it is attached;

It is also an object of the present invention to provide an atomizer pump which can be conveniently attached to containers by means of a number of attachment devices.

The foregoing objects are achieved in a pump dispenser adapted to be attached to a container having a bottom and an upstanding sidewall and holding a liquid to be dispensed. The pump dispenser includes a cylindrical pump chamber having an upper, larger diameter section and a lower, smaller diameter section. An upper piston and a lower piston are received in their respective chamber sections, each of the pistons having a hollow stem attached. Resilient means are provided for biasing both of the pistons upwardly whereby the pistons are receiprocable by downward pressure on the upper piston stem and release of the downward pressure. A flexible dip tube has its upper end coupled to the lower piston and extends through an opening provided in the lower pump chamber section. The dip tube has its lower end adjacent to or in contact with the bottom wall of the container and is movable across the bottom wall to insure that the lower end extends into the immediate area of the intersection of the bottom wall and the sidewall of the container when the lower piston is moved from its uppermost to its lowermost position to permit dispensing of substantially the entire liquid contents of the container.

The above objects are also achieved in a pump dispenser such as described above, but which also has means provided on the wall of the lower, smaller diameter section of the pump chamber which cooperates with the second piston to permit air entrapped in the upper and lower body portions of the chamber to be discharged through an opening that is provided in the lower end of the lower body portion whereby the air from the priming is expressed directly into the air space of the container.

The present pump dispenser may be used on containers made of glass, metal or plastic.

Other objects and advantages of the present invention will be more readily apparent from a further consideration of the following detailed description of the drawings and the preferred embodiments of the invention.

DESCRIPTION OF THE DRAWINGS

FIG. 1 is an axial, elevational, cross-sectional, broken view of the pump of the present invention attached to a container showing the upper and lower pistons in the fully raised position and the lower end of the dip tube located in the central portion of the bottom of the container;

FIG. 3 is a view similar to FIG. 1 with the upper and lower pistons being shown in the positions shortly after the beginning of the upstroke of the two pistons and showing the lower end of the dip tube just short of its extended position when the pump chamber has been filled with liquid after the pump is primed;

DESCRIPTION OF THE PREFERRED EMBODIMENTS

Figure 2:
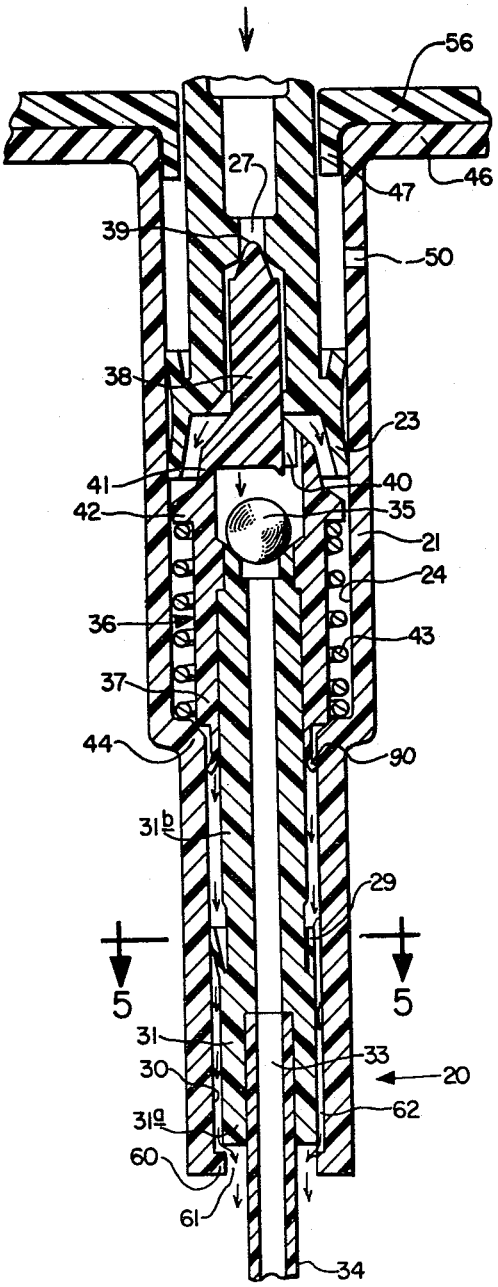
FIG. 2 is a broken, enlarged view of the pump shown in FIG. 1 with the pistons in bottom, or lowermost, position during a priming stroke with the compressed air venting around the lower piston and out of the opening in the lower portion of the pump chamber.

Referring now in particular to FIGS. 1–5, the dispensing pump of the present invention includes a pump body or housing, designated generally by the numeral 20. The body includes an enlarged diameter, upper body section 21 which is integrally formed and communicates with a smaller diameter lower body section 22. The housing 20 is preferably cylindrical. Received in the upper end of the upper body section is an upper, or first, piston 23 made of a resilient material so that it closely and slidingly contacts the inner wall 24 of the upper body section to provide a liquid and air seal therewith. The piston depicted in the drawings is a double-skirted piston that is formed with an upstanding, hollow, upper stem 25 provided with a hollow or a bore 26 therethrough. The bore is provided with a restricted diameter opening 27 intermediate its length. A conventional mechanical breakup spray actuator button (shown in phantom) is attached to the top of the upper stem 25. The spray actuator button may be of any of the general mechanical breakup spray actuator types commonly used on finger-actuated pumps for atomizing liquids, i.e., that type of spray actuator shown in U.S. Pat. No. 3,223,292 incorporated hereby by reference.

The lower body section 22 is provided with a lower, single skirted piston 29 made of resilient material and having its periphery in sliding, liquid tight contact with the interior wall 30 of the lower body section. The piston is integrally formed with a lower stem 31 which is provided with a bore 32 for the passage of fluid therethrough. The lower stem has a lower portion 31*a* which extends below the lower piston 29 and an upper portion 31*b* which extends above the lower piston 29 into the interior of the upper body section 21. The lower portion of the lower stem 31*a* is provided with a counterbore 33 in its end which frictionally receives the upper end of a flexible, thin-wall dip tube 34. The upper portion of the lower stem is normally closed by a ball check valve 35 seated on a beveled surface provided at the end of the upper portion of the lower stem.

A check valve cage assembly, designated generally by the numeral 36, has a hollow lower portion 37 which may be press fitted, or attached by other means, over the upper portion of the lower stem so that it is firmly attached thereto. The check valve cage assembly is provided with an upper, solid, cylindrical, outlet check valve portion 38 which has a rounded tip 39 that seats on the interior wall portion of the upper stem which defines the restricted diameter opening 27 to thereby provide an outlet check valve for the pump. A plurality of openings 40 are provided in the intermediate portion of the check valve cage assembly and are defined by means of a plurality of spaced apart. ribs 41 which connect the hollow, lower portion 37 of the check valve cage assembly to the check valve portion 38 to provide a rigid assembly. The upper portion of the check valve cage assembly is provided with an outwardly extending, annular shoulder 42 which has its underside in contact with the upper end of compression spring 43 that has its lower end seated on a shoulder 44 at the juncture of the upper and lower body sections of the pump housing.

Components of the pump that are positioned within the housing are retained therein by means of an annular collar member 45 seated on the top surface of an annular flange 46 that is integrally formed with the upper portion of the housing 20. The collar member 45 is provided with an annular, downwardly extending portion 47 which abuts the upper end of the piston 23 to limit its upward travel. An annular air space 48 is provided between the collar 45 and the upper stem 25 to permit flow of air from the atmosphere to the interior of the container 49 through an opening 50 provided in the sidewall of the upper body section 21. The underside of the annular flange 46 is sealingly engaged with the upper surface of an annular gasket 51, preferably made of an elastomeric or plastic material, which has its lower surface seated on the top of the lip 52 provided at the upper end of the neck 53 of container 49. Collar member 45, annular flange 46 and annular gasket 51 are sealingly engaged with each other and the top lip of the neck 52 by means of a ferrule member, designated generally by the numeral 54. The ferrule has a downturned, inner, circular periphery 55 received in a groove provided in the inner, upper portion of the collar member 45 and spaced from and surrounding the stem 25. Top portion 56 of the ferrule abuts the surface of collar member 45 and has attached thereto a downwardly depending skirt portion 57. The skirt portion is provided with spaced apart indentations 58*a* which hold the gasket 51 firmly against the bottom of the annular flange 46 so that this gasket can be combined with the pump assembly at the assembly point and shipped to the customer with the gasket retained in place. The entire pump assembly is firmly attached to the neck of the bottle 49 by means of a crimped, or rolled under, lower peripheral portion 58 which is received around an annular projection bead 59 provided on the bottle neck 53.

The bottom of the lower body section 22 is provided with inwardly extending, annular flange 60 which is spaced from the dip tube to provide an annular air space 61. This annular air space 61 provides a path for flow of air from the interior of the pump housing when the pump is initially or subsequently primed with fluid from the container.

Figure 4:
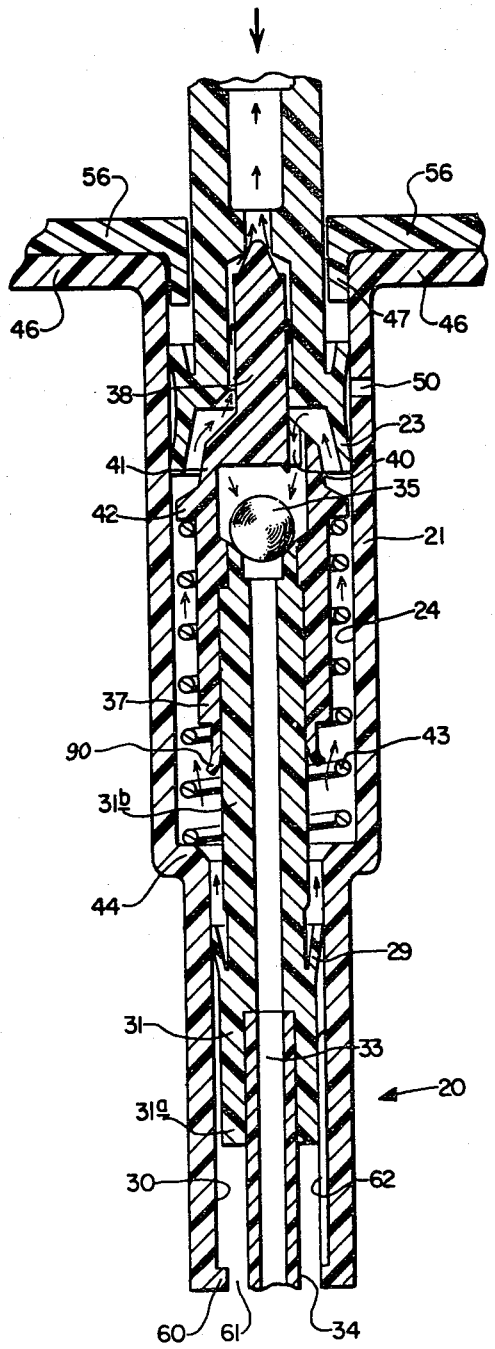
FIG. 4 is a view similar to FIG. 2 showing the two pistons moving downward with the chamber full of fluid which is being discharged.
Figure 5:
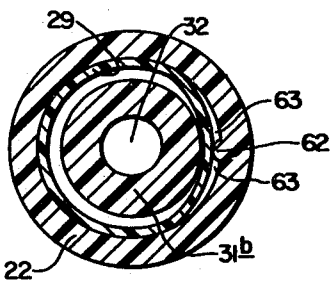
FIG. 5 is an enlarged portion of a cross section of FIG. 2 along the line 5—5 showing the air escape route around the periphery of the piston and the ridge on the inner wall of the lower pump chamber.
Figure 6:
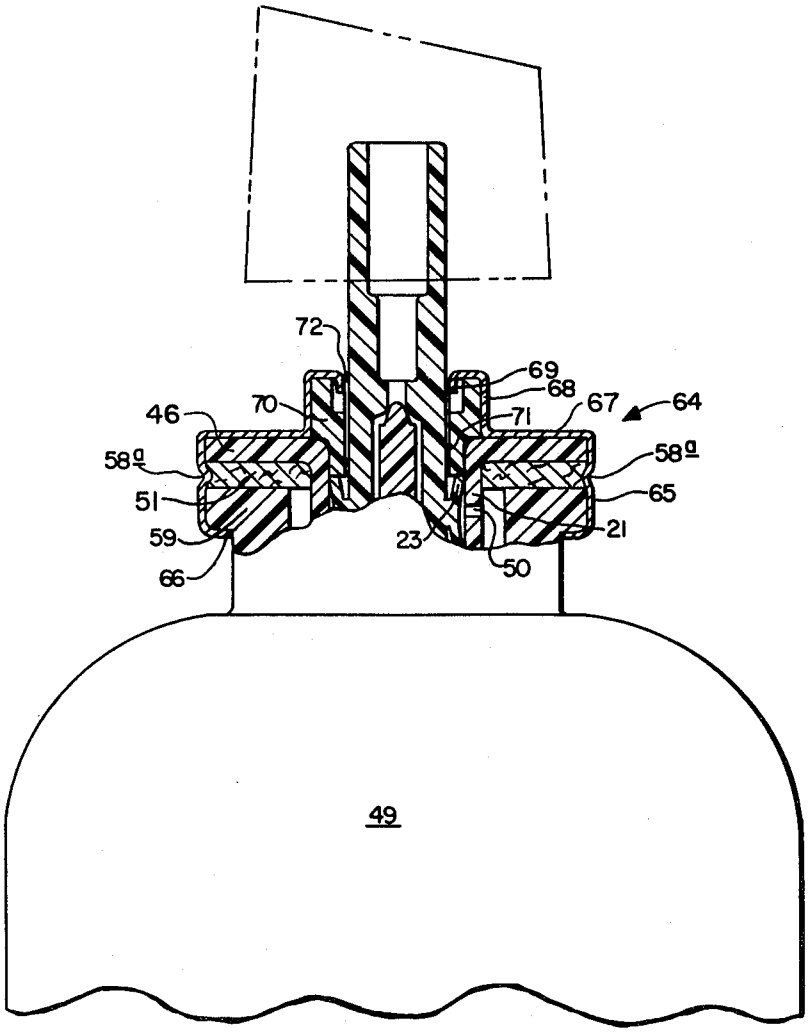
FIG. 6 is a view of the pump of the present invention showing an alternate ferrule with a pedestal for attaching the pump to the container.

As seen in FIGS. 1 and 4, the inside wall 30 of the lower body section is provided with an integrally formed rib 62 which extends from the lower annular projection 60 on the end of the body upwardly a distance sufficient to be contacted by the peripheral edge of the lower piston 29 when this piston is in its lowermost position as seen in FIG. 2 particularly. In place of rib 62, a groove or an opening in the sidewall of the lower body may be used. On initial use and often after the pump has been standing for some time, it is necessary to prime the pump to remove the air contained between the middle or seal piston 90 and lower piston 29. To accomplish this, the pump is reciprocated through its full stroke a number of times and when the pump is at the fully compressed position, as shown in FIGS. 2 and 5, the compressed air trapped between the seal piston 90 and lower piston 29 is compressed until the lower piston moves into contact with the rib 62 to flex a portion of its periphery as seen more clearly in FIG. 5. In this condition, an air passage 63 is provided by virtue of the rib flexing a portion of the periphery of the piston 29 to create these passages on either side of the rib. Compressed air from the lower body chamber of the pump then passes through the annular space between the lower piston body 22 and lower stem extension 31*a* into the space therebelow and ultimately out the annular air space 61 provided at the bottom of the lower body between the projection 60 and the dip tube 34. This air exhausted during the priming of the pump thus passes directly into the vapor or air space 78 in the container above the liquid level that is present in the container. Thus, there is no necessity for the air to replace additional air and/or fluid which is standing in the dip tube in order to prime the pump as is the case with prior art pumps. Additionally, there is no need for the air to be expressed up the side of the body and out of vent holes which had been heretofore used to assist in priming finger pump dispensers. Referring now to FIG. 6, another embodiment for attaching the dispenser pump of the present invention to the container 49 is illustrated. A pedestal-type ferrule, indicated generally by the number 64, is used to attach the pump to the bead 59 provided on the neck of the container 49. The pedestal has a depending skirt 65 that has periodic indentations 58*a* which grip the gasket 51 as previously described. The ferrule has a turned under lower portion 66 which grips the bead 59 on the neck of the container to secure the pump tightly to the container. The ferrule has an annular, outer, top surface 67 which merges into an upturned cylindrical pedestal portion 68. The top of the pedestal has an annular opening defined by a downturned end 69. An annular collar 70 is received inside the ferrule in the space provided on the interior of the pedestal 68. The collar is provided with a downwardly extending, smaller diameter, lower portion 71 which extends into the open upper end of the upper body section 21 and abuts the top of upper piston 23 to limit its upward travel. An annular air passage 72 is provided between the inner wall of the annular collar 70 and the upper stem 25 so that atmospheric air will be admitted through this annular air passage and the opening 50 provided in the upper body 21 to prevent a vacuum being formed in the container as the contents are dispensed over a period of time.

It is understood that, instead of using a ferrule for attaching the dispenser pump to the container in cases where it is desired to attach the pump to a threaded neck container, a metal or plastic screw cap can be utilized in the place of the ferrule. In this instance, the cap would be provided with a top portion similar to the collar member 45 shown in the drawings herein and would have a downturned end surrounding an annular central opening from which the stem would project. The downturned end would abut the upper end of the piston 23 in the same manner as the inner peripheral portion 47 of the collar 45.

The operation of the dispenser pump will now be described with reference to FIGS. 1–5. At the filling plant, the container 49 will be filled with a liquid preparation 73 which may be, for example, a perfume, cologne, antiperspirant, or other product desired to be dispensed by the pump dispenser. The preassembled pump is placed on the container neck, and the lower part of the ferrule 58 is crimped around the underside of the bead 59 to sealingly attach the pump assembly to the container. Ideally, the dip tube will be cut to a length that places the lower end 74 of the dip tube in the peripheral portion 79 at the bottom of the container when the pump is in the up position so that when it is depressed, the dip tube will remain in the peripheral portion and slide around the peripheral portion. However, often the bottle depth B is greater than specified with the result that the dip tube has a length which will place its lower end 74 immediately above or in contact with the circular central portion 75 of the top surface 76 of the concave cylindrical bottom 77 of the container 49.

Generally, upon receipt of the product package by the consumer, the interior of the pump body 20 is filled with air. Additionally, the passage of the dip tube 34 may also still contain air, and it will be necessary to prime the pump by evacuating the air from the pump body and the dip tube interior. Priming is accomplished by depressing the actuator button to move the upper, middle and lower pistons 23, 90 and 29, respectively, downwardly in their respective body sections thereby compressing the air therein. When the lower piston 29 makes contact with the rib 62, the air passages 63 will be opened as can be seen in FIG. 5. Compressed air trapped between the middle and the lower pistons will then be partially evacuated through the opening 61 in the lower part of the lower body section into the air space 78 provided in the container above the liquid level and the mouth of the container. On the upstroke or release of the pressure on the actuator, liquid will move up the dip tube, lift the inlet check ball 35 and flow into the upper and lower sections of the housing as illustrated in FIG. 3. Generally, it will require more than one reciprocation of the pistons to completely evacuate the air from the interior of the pump housing and to fill it with fluid. After the pump housing is fluid full, the next full stroke actuation will produce the compression of the liquid between the upper and lower pistons and due to the well-known principle of accumulative pressure pumps, the smaller diameter lower piston 29 will begin to move at an increased rate compared to the speed of the upper piston 23 when the fluid in the body has reached a certain pressure. This increased speed of the lower piston will disengage the rounded tip 39 on the upper check valve 36 thereby permitting fluid to be expressed through the bore in the upper stem out through the atomizer button and dispensed in the form of very fine mist or atomized spray. When the upper check valve tip 39 moves away from the restricted opening 27 in the stem, t he fluid under pressure immediately exits the dispenser nozzle under high pressure thereby producing an instant atomization of the liquid which is highly desirable. As the liquid 73 is displaced from the container, atmospheric air enters the air space 78 above the liquid to relieve the vacuum that may be created therein through the annular air space 48 between the column member and the stem and through the side opening 50 in the tank when the upper piston is located below this opening at the end of the downstroke as seen in FIG. 3.

During each downstroke of the pistons to discharge quid from the dispenser, the dip tube 34 will move downward in the container a distance determined by the dimension designated A which is the height from the bottom of the lower portion 37 of the check valve cage assembly and the shoulder 44 defining the intersection of the upper and lower body portions. As previously indicated, the present dispenser pump is ideally suited for use in very small, hand-held containers for perfume and the like, and generally these are desired to be constructed of glass to insure the purity of the contents and to permit the consumer to visually inspect the product in the container to determine if there has been leakage from the package prior to purchase. Additionally, clarity of the container is desired so that the purchaser may determine when the product is near exhaustion or has been exhausted. As mentioned hereinbefore, it is extremely desirable to be able to evacuate substantially all of the product, particularly when it is in the nature of an expensive perfume or cologne, from the interior of the container. The present invention achieves this by the downward movement of the dip tube 34 which on the downstroke results in the lower end of the dip tube 74 contacting the upper surface 76 of the container bottom and sliding from the generally central circular section 75 into the extreme peripheral portion of the bottom 79 which is defined by the intersection of the convex inner surface 76 of the container and the vertical inner wall 80. This lower end of the dip tube will thus, over a period of time, be reciprocated across the bottom surface 76 of the container into the peripheral edge portion 79. Many times, it will be possible to substantially remove the entire contents of the container thus avoiding the waste which is now commonly present in perfume and cologne atomizer pumps because of their fixed dip tube length.

It is commonly known that glass containers cannot be made in such a manner as to control with close tolerances the distance B (see FIG. 1) between the top of the lip 52 and the uppermost part of the inner bottom surface 76 of the container. Due to this high variance in distance B, it is quite common for conventional pump dispensers with fixed, precut dip tube lengths to quite often be spaced quite some distance above the bottom of the container. Since they are not movable as is the dip tube in the present pump dispenser, it is virtually impossible to utilize the portion of the contents once it drops below the lower end of the dip tube.

While the lower end of the dip tube 74 shown in the present embodiments of the pump dispenser is shown with a transverse or flat cut, it is also anticipated that a diagonal cut, or step cut, may be utilized at the lower end of the dip tube to insure that this end will not block by being forced into contact with the bottom surface of the container by the downward stroke of the pistons. It has been observed that generally a very small-diameter, thin-wall dip tube of the type desired to be used in the present invention has a slight bend or curvature which is generally uniform over its length when it is installed in the pump assembly. It is believed that the curvature is the result of the cold set assumed by the plastic from being stored on spools in an endless coil form, which tubing is normally received from manufacture prior to being cut and fitted in the pump assembly during its manufacture. Thus, the tube will have a general tilt away from the centerline of the assembly which will expedite its movement across the bottom of the container and permit it to readily enter the peripheral portion 79 to extract the last vestige of liquids therefrom.

The lower portion 37 of the check valve cage assembly 36 is provided with an intermediate or middle seal piston 90 at its lower end. After the pump is primed the liquid that remains in the upper body section 21 at the bottom of each stroke of the pump is prevented from flowing into the lower body section 22 and out the opening 61 by the engagement of the middle seal piston 90 with the interior wall 30 of the upper part of the lower body section 22 as seen in FIG. 2. The length of the lower portion 37 of the check valve cage assembly is adjusted so that the seal piston 90 engages the uppermost portion of the interior wall 30 preferably just prior to contact of the lower piston 29 with the rib 62. However, if desired, the contact of the seal piston may be made simultaneously with, or slightly after the lower piston contacts the rib. Prior to this improvement in the pump disclosed in U.S. Pat. No. 4,278,189 at the bottom of each stroke some or all of the pressurized liquid remaining in the upper housing would drain out into the container 49 through opening 61 when the lip of the lower piston 29 was deflected by contact with the rib 62 as seen in FIGS. 2 and 5. This loss of liquid in the upper body prevented the pump from achieving the maximum discharge of atomized liquid on each stroke of the pump. Also this results in improved evacuation of the liquid contents of container 49.

The invention has been described in preferred embodiments but should not be limited to those described and illustrated, it being understood that modifications may be made thereto which are in the ability of those skilled in the art and that the invention described herein should be limited only by the scope of the claims contained herein.

What is claimed is:

1. In a pump dispenser adapted to be attached to a container holding a liquid to be dispensed, the combination comprising:

(a) means defining a cylindrical pump body having a first section and a second section, said second section being of a smaller diameter than said first section;

(b) a first piston received in said first body section and having an attached first stem means having a fluid passage therein extending out of said body section;

(c) a second piston received in said second body section and having an attached second stem means having a fluid passage in its lower portion and a solid upper portion normally contacting said first stem means to close the fluid passage therein;

(d) a third seal piston attached to said second stem means between said first piston and said second piston, and having an outwardly flared skirt that makes a sealing engagement with the uppermost portion of the interior wall of said second body section when said third seal piston is moved to its lowermost position;

(e) a dip tube means having its upper portion passing through an opening of larger diameter than said dip tube that is provided in the lower end of said second body section, the dip tube upper end being coupled to said second piston and movable therewith; and, (f) means provided on the wall of said second body section to cooperate with said second piston to permit air entrapped in said first and second body sections to be discharged through the opening in the lower end of said second body section into the air space of said container upon the priming of the pump.

2. In the pump dispenser of claim 1, wherein spring means are provided in said first body section, the upper end of said means being coupled to said second stem means at a point above said second piston.

3. In the pump dispenser of claim 1, wherein said pump body has a cylindrical flange at its upper end and a closure means received over said flange for attaching said pump to said container.

4. In the pump of claim 3, wherein said closure means includes cap means for attaching said pump to a neck that is provided on said container.

5. In the pump of claim 3, wherein said closure means includes a ferrule means.

6. In the pump of claim 5, wherein said ferrule means includes a central upstanding pedestal portion which encloses a collar means slidably surrounding a part of said first stem means and abutting said first piston to limit its upward movement.

7. In a pump dispenser adapted to be attached to a container having a bottom and an upstanding sidewall and holding a liquid to be dispensed, the combination comprising:

(a) means defining a cylindrical pump chamber having an upper, larger diameter section and a lower, smaller diameter section;

(b) an upper piston and a lower piston received in their respective chamber sections, each of said pistons having hollow stem means attached thereto;

(c) a third seal piston attached to said stem means that is attached to said lower piston at a location between said upper piston and said lower piston, and having an outwardly flared skirt that makes a sealing engagement with the uppermost portion of the interior wall of said second body section when said third seal piston is moved to its lowermost position;

(d) resilient means biasing said pistons upwardly, said pistons being reciprocable by downward pressure on said upper piston stem means and release of said pressure;

(e) a flexible dip tube having its upper end coupled to said lower piston and extending through an opening provided in said lower pump chamber section; and (f) said dip tube having its lower end adjacent to or in contact with the bottom wall of the container and being movable across said bottom wall to insure that said lower end extends into the immediate area of the intersection of the bottom wall and sidewall of the container when said lower piston is moved from its uppermost to its lowermost position to permit dispensing of substantially the entire liquid contents of the container.

8. In the pump dispenser of claim 7, wherein the pump is attached to a container having a flat bottom.

9. In the pump dispenser of claim 7, wherein said container has a convex bottom.

10. In the pump dispenser of claim 8, wherein said container is a glass container.

11. In the pump dispenser of claim 8, wherein said container is a metal container.

12. In the pump dispenser of claim 8, wherein said container is a plastic container.

13. In the pump dispenser of claim 9, wherein said container is a glass container.

14. In the pump dispenser of claim 9, wherein said container is a metal container.

15. In the pump dispenser of claim 9, wherein said container is a plastic container.

* * * * *